US006098309A

United States Patent [19]

Halmschlager et al.

[11] Patent Number: 6,098,309

[45] Date of Patent: Aug. 8, 2000

[54] MACHINE AND PROCESS FOR MANUFACTURING OR TREATING A MATERIAL WEB

[75] Inventors: Guenter Halmschlager, Krems; Walter Holzer, St. Pölten, both of Austria

[73] Assignee: Voith Sulzer Papiertechnik Patent GmbH, Heidenheim, Germany

[21] Appl. No.: 09/160,039

[22] Filed: Sep. 25, 1998

[30] Foreign Application Priority Data

Sep. 29, 1997 [DE] Germany ..... 197 42 856

[51] Int. Cl.[7] ..... F26B 7/00

[52] U.S. Cl. ..... 34/420; 34/273

[58] Field of Search ..... 34/420, 421, 422, 34/117, 266, 267, 273, 120

[56] References Cited

U.S. PATENT DOCUMENTS

| | | |
|---|---|---|
| 4,693,015 | 9/1987 | Hemsath et al. . |
| 5,553,391 | 9/1996 | Bakalar . |

FOREIGN PATENT DOCUMENTS

| | | |
|---|---|---|
| 280762 | 4/1970 | Austria . |
| 308524 | 7/1973 | Austria . |
| 0427218 | 5/1991 | European Pat. Off. . |
| 1114080 | 9/1961 | Germany . |
| 2027420 | 12/1971 | Germany . |
| 232113 | 12/1973 | Germany . |
| 2635337 | 2/1977 | Germany . |
| 1046087 | 10/1966 | United Kingdom . |
| 95/27877 | 10/1995 | WIPO . |

*Primary Examiner*—Denise L. Ferensic
*Assistant Examiner*—Malik N. Drake
*Attorney, Agent, or Firm*—Greenblum & Bernstein, P.L.C.

[57] ABSTRACT

Apparatus and process for manufacturing or treating a material web that includes at least one heatable cylinder and a combustion unit. The combustion unit is adapted to heat the at least one heatable cylinder with at least one of combustion gases and infrared radiation and the material web is adapted to be guided one of alone and with a transport belt over the at least one heatable cylinder. The apparatus also includes at least one blower box positioned to direct a hot gas onto the material web. The hot gas is at least one of the combustion gas and heated by the combustion gases. The process includes heating the at least one heatable cylinder with at least one of combustion gases and infrared radiation of the combustion unit, guiding the material web, one of alone and with a transport belt, over the at least one heated cylinder, and directing a hot gas from the blower box onto the material web, the hot gas being at least one of the combustion gas and heated by the combustion gases.

28 Claims, 1 Drawing Sheet

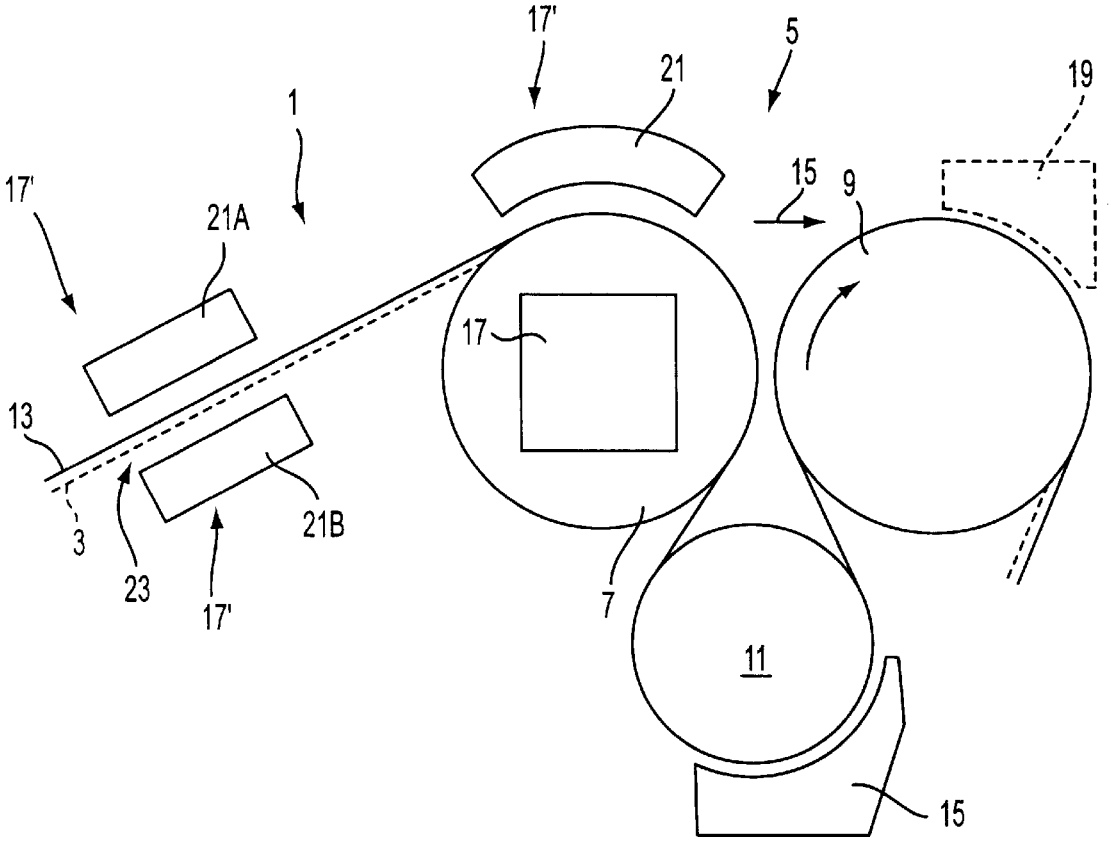
17'
21
5
19
1
15
9
17'
21A
17
13
3
23
17'
21B
7
11
15

MACHINE AND PROCESS FOR MANUFACTURING OR TREATING A MATERIAL WEB

CROSS-REFERENCE TO RELATED APPLICATIONS

The present application claims priority under 35 U.S.C. § 119 of German Patent Application No. 197 42 856.8 filed Sep. 29, 1997, and German Patent Application No. 197 52 562.8 filed Nov. 27, 1997, the disclosures of which are expressly incorporated by reference herein in their entireties.

BACKGROUND OF THE INVENTION

1. Field of the Invention

The present invention relates to a machine for manufacturing or treating a material web, e.g., a paper or cardboard web, by guiding the web, either alone or with a transport belt over at least one heatable cylinder, the cylinder comprising a combustion unit being adapted to be heated with at least one of combustion gases and infrared radiation, and a process for drying a material web, in particular a paper or cardboard web, by guiding the web, either alone or with a transport belt over the at least one heatable cylinder and heating the heatable cylinder with a combustion unit comprising at least one of combustion gases and infrared radiation of a combustion unit 2. Discussion of Background Information A directly heated cylinder utilized in a dryer section of a paper or cardboard machine to dry a paper or cardboard web guided over its surface is known from U.S. Pat. No. 5,553,391. A combustion unit that produces infrared radiation by burning gas heats the cylinder to temperatures usually ranging between 160° C. and 450° C., and is placed in the interior of the cylinder. The high energy input to dry the material web and the high costs for performing the drying process are disadvantages of this known system.

It is also known to heat the cylinder to temperatures of 130° C. to approximately 200° C. with steam. The energy input for drying the material web in this manner is lower than with direct heating of the cylinder. However, the temperatures that can be obtained via steam are limited to approximately 200° C. Further, the associated costs for this type of system are significant because of extensive space requirements for the steam heating units required for heating of the cylinder, e.g., a piping system feeding the steam and the condensate, a heat exchanger, etc.

A dryer section is also known from EP 0 427 218 B 1 that consists of a steam-heated cylinder and blower boxes. Via the blower boxes, a hot gas, e.g., air, at an elevated temperature of between approximately 150° C. and 450° C. and at a high velocity of between approximately 50 m/s and 100 m/s is blasted onto the material web. In this manner, high evaporation rates are obtained on small surface areas. However, the energy input necessary to heat blown gas is usually so high that the total energy efficiency of this process, i.e., the combination of the dryer cylinder and blower boxes, is lower by several percentage points, than the drying process utilizing only steam heated cylinders.

SUMMARY OF THE INVENTION

Therefore, the present invention provides a process and a machine having a simple construction method to achieve a high drying effect while using a relatively low amount of energy.

Thus, the present invention provides a machine for manufacturing or treating a material web, e.g., a paper or cardboard web, by guiding the web, either alone or with a transport belt over at least one heatable cylinder, the cylinder comprising a combustion unit being adapted to be heated with at least one of combustion gases and infrared radiation. The machine also includes at least one blower box adapted to direct a hot gas that is either combustion gas or heated by combustion gases onto the material web and/or the transport belt. Via the at least one blower box, the hot gas that is blasted onto the material web and/or the transport belt to produce a high drying effect while using a low amount of energy.

The combined effect of the blower box and the cylinder into a compact unit results in an improved drying process. In this way, high vaporization rates can be achieved on small surface areas to reduce the number of cylinders required for the drying of the material web. Moreover, in accordance with the features of the present invention, existing machines for manufacturing or treating a material web can be retrofitted in a simple manner. It is noted that the term "directly heatable," as utilized herein, refers to a heat-carrying medium, e.g., combustion gases of the combustion unit, that is not exchanged, but that is used to directly heat the cylinders.

In accordance with an exemplary embodiment of the present invention, the hot gas may be combustion gas or a gas mixture that contains combustion gases. Combustion gas is a hot gas that is clean and dry enough to be blasted directly onto the material web. However, if, in accordance with an alternative embodiment, the combustion gas is too moist and/or too contaminated, the combustion gas may be used to heat the hot gas that is to be blasted onto the material web via the blower box. By utilizing the combustion gases of the combustion unit in conjunction with the blower box, the drying effect, i.e., compared to drying with steam-heated cylinders alone, can be increased while using the same energy input. Further, using the combustion gases several times, i.e., for several units, reduces costs associated with a heat exchanger utilized to reclaim energy from the exhaust air of the combustion unit. In some cases, the heat exchanger may be completely eliminated.

In another exemplary embodiment of the present invention, the exhaust gas from the blower box and/or fresh air can be admixed with the hot gas. The exhaust air from the blower box has a temperature higher than the ambient temperature or fresh air so that the energy expended to heat the exhaust air to the desired temperature of the hot gas is lower than that required to heat the fresh air. The temperature of the hot gas to be blasted onto the material web may be, e.g., between approximately 250° C. and 450° C. If the combustion gas is blasted directly onto the material web, i.e., without changing the heating medium, the desired temperature may be regulated by admixing exhaust air and/or fresh air, as noted above.

In still another embodiment of the present invention, the heating medium may be exchanged, i.e., the combustion gas may be utilized to heat up another gas, e.g., exhaust air of the blower box and/or fresh air. The exchange of the heating medium is performed, e.g., when a moisture content of the combustion gases is too high and/or the gases are contaminated, i.e., they have or are carrying particles, to such a degree such that the material web quality is impaired. In both situations, a high drying effect can be achieved while using a relatively low amount of energy. Thus, in addition to economic advantages, the present invention also helps to minimize environmental impact.

In another embodiment of the present invention, the combustion unit may be fueled with either oil or a flammable gas. Utilizing gas as the fuel may be particularly advantageous because the environmental impact of its combustion gases are very low and the combustion gases produced by burning gas is cleaner than the combustion gases produced by burning oil. Thus, in many cases the combustion gases produced by burning gas can be blasted directly onto the material web via the blower box. In this way, the temperature of the gas can also be adjusted by admixing with the exhaust air of blower box and/or fresh air.

In an advantageous embodiment of the present invention, the combustion unit may be placed within the interior of the cylinder. In this manner, the cylinder acts as a quasi-combustion chamber to produce the hot gas for heating the cylinder and the blower box. Thus, the "combustion chamber" efficiently heats the material web and/or adjusts the moisture cross-directional profile while producing the hot gas for the blower box. The exhaust air escaping from the cylinder, i.e., the combustion gases, can be supplied directly to the blower box or to a heat exchanger to heat the hot gas of the blower box. However, it is also possible to mount the combustion unit on an exterior of the cylinder or in a vicinity of the cylinder exterior and to guide the combustion gases into the cylinder. Independent of the arrangement of the combustion unit, the combustion gases are used to dry the material web to increase the intensity of the drying process and to release energy through the combustion of the fuel.

In accordance with a further embodiment of the present invention, the blower box, which may be arranged to extend across an entire width of the material web, may include a plurality of zones that, independently of each other, blast hot gas toward the web. The temperature and/or amount of hot gas in each respective zone can be adjusted so as to adjust/regulate the moisture cross-directional profile of the web.

The present invention also relates to a process for drying a material web, in particular a paper or cardboard web, by guiding the web, either alone or with a transport belt over the at least one heatable cylinder and heating the heatable cylinder with a combustion unit comprising at least one of combustion gases and infrared radiation. The process also includes directing hot gas from a blower box onto the material web and/or the transport belt. The hot gas may include one of combustion gas and gas heated by combustion gases.

The blower box, e.g., a suction-blower box, may be utilized to apply hot gas to the material web and/or to the transport belt carrying the material web. The hot gas may be heated by combustion gases within the combustion unit so as to directly heat the at least one cylinder, or may be composed of combustion gas. Due to the reuse of the combustion gases in the drying process of the material web, the energy load required for drying material web can be reduced.

Further, combustion gases of the combustion unit may be used for directly heating a cylinder. The combustion gas may be blasted onto the material web via the blower box after escaping from the cylinder. In this manner, high vaporization rates on small surface areas may be achieved. The combustion gases may be used for heating a gas, e.g., fresh air and exhaust air of the blower box. This heated gas may be blasted onto the material web. In order to avoid web tears, it may be advantageous to blast the hot gas onto a temperature-resistant transport belt/dryer screen carrying or guiding the material web. It is noted that the drying effect is not significantly changed with an appropriately large, open surface area of the dryer screen.

Accordingly, the present invention is directed to an apparatus for manufacturing or treating a material web that includes at least one heatable cylinder and a combustion unit. The combustion unit is adapted to heat the at least one heatable cylinder with at least one of combustion gases and infrared radiation and the material web is adapted to be guided one of alone and with a transport belt over the at least one heatable cylinder. The machine also includes at least one blower box positioned to direct a hot gas onto the material web. The hot gas is at least one of the combustion gas and a gas heated by the combustion gases.

In accordance with another feature of the present invention, the hot gas includes at least one of exhaust gas of the blower box and fresh air.

In accordance with another feature of the present invention, the combustion unit includes one of an oil and a flammable gas fuel.

In accordance with still another feature of the present invention, the combustion unit is positioned within an interior of the at least one heatable cylinder.

In accordance with a further feature of the present invention, the machine includes a deflection roll. The material web is guided around the deflection roll, and the combustion unit is positioned opposite at least one of the at least one heatable cylinder and the deflection roll.

In accordance with another feature of the present invention, the machine is adapted for use within at least one of a dryer section, a press section, and a wet section of a material web manufacturing machine.

In accordance with a still further feature of the present invention, the at least one blower box includes a plurality of zones that extend transversely to a web run direction, and the plurality of zones is adapted to blast the hot gas independently of each other. Further, a regulator/control unit is provided that influences at least one of a temperature and an amount of gas to be fed into the plurality of zones.

In accordance with still another feature of the present invention, the machine includes a deflection roll. The material web is guided around the deflection roll, and the at least one blower box is associated with at least one of the at least one heatable cylinder and the deflection roll.

In accordance with another feature of the present invention, the at least one heatable cylinder is adapted to be heated to a temperature between approximately 100° C. and 400° C. Further, the at least one heatable cylinder is adapted to be heated to a temperature between approximately 160° C. and 350° C.

In accordance with a further feature of the present invention, the hot gas is adapted to be heated to a temperature between approximately 150° C. and 600° C. Further, the hot gas is adapted to be heated to a temperature between approximately 250° C. and 450° C.

In accordance with still another feature of the present invention, the material web includes one of a paper web and a cardboard web.

The present invention is also directed to a process for drying a material web in a machine for manufacturing or treating a material web that includes at least one heatable cylinder, a combustion unit, and at least one blower box. The process includes heating the at least one heatable cylinder with at least one of combustion gases and infrared radiation of the combustion unit, guiding the material web, one of alone and with a transport belt, over the at least one heated cylinder, and directing a hot gas from the blower box onto the material web, the hot gas being at least one of the combustion gas and a gas heated by the combustion gases.

In accordance with another feature of the present invention, the process includes feeding at least one of exhaust gas from the blower box and fresh air into the hot gas.

In accordance with another feature of the present invention, the process includes fueling the combustion unit with one of oil and flammable gas.

In accordance with still another feature of the present invention, the process includes separating the blower box into a plurality of zones to blast the hot gas across a width of the material web. Further, the process includes controlling/regulating at least one of a temperature and an amount of gas being fed into the plurality of zones.

In accordance with a further feature of the present invention, the at least one cylinder is heated to a temperature between approximately 100° C. and 400° C. Further, the at least one cylinder is heated to a temperature between approximately 160° C. and 350° C.

In accordance with still another feature of the present invention, the hot gas is heated to a temperature between approximately 150° C. and 600° C. Further, the hot gas is heated to a temperature between approximately 250° C. and 450° C.

In accordance with another feature of the present invention, the material web is comprised of one of a paper and a cardboard web.

The present invention is also directed to a process for manufacturing or treating a material web in a web producing machine that includes directly heating a cylinder of the machine with combustion gases of a combustion unit, and applying the heated gas toward the material web via a blower box. The heated gas is at least one of the combustion gases and a gas heated by the combustion gases.

In accordance with still another feature of the present invention, the process includes guiding the material web over the heated cylinder with a transport belt, and directing the applied heated gas through the transport belt to the material web.

The present invention also includes a web manufacturing or treating apparatus that includes at least one heatable cylinder and a combustion unit that is adapted to produce combustion gas to heat the at least one heatable cylinder. The material web is adapted to be guided belt over the at least one heatable cylinder, and the machine includes at least one blower box positioned to direct a hot gas composed of one of the combustion gas and a gas heated by the combustion gas.

In accordance with yet another feature of the present invention, a transport belt is adapted to guide the material web over the at least one heatable cylinder, and the at least one blower box is positioned to direct the hot gas onto the material web through the transport belt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the drawing by way of non-limiting examples of embodiments of the present invention, and wherein:

The FIGURE schematically illustrates a portion of a machine for manufacturing a material web, e.g., a paper or cardboard web.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The FIGURE schematically illustrates a portion of a machine 1 for manufacturing a material web 3 (shown in dashed line), e.g., a paper or cardboard web. The portion of machine 1 may be, e.g., a dryer section 5. Dryer section 5 may be include a plurality of heatable cylinders for drying material web 3. As depicted in the FIGURE, only cylinders 7 and 9 of a single-row dryer group are shown along with a deflection roll 11, e.g., a suction roll, positioned below cylinders 7 and 9. Suction rolls as utilized in the present invention are known in the art, and no further description is necessary. Material web 3 guided with a transport or support belt 13 in a run direction indicated by arrow 15 over cylinder 7, around deflection roll 11, and over cylinder 9. Transport belt 13, also referred to as a dryer screen or felt, may be formed of a material that allows gas and/or fluid to permeate. While material web 3 is guided over cylinders 7 and 9, it is also pressed against the cylinder circumference (surface) by pre-tensioning of support belt 13. As material web 3 is guided around deflection roll 11, it is positioned on an exterior side of support belt 13, i.e., away from the surface of deflection roll 11.

A combustion unit 17, which is positioned within an interior of cylinder 7, is depicted only very schematically, and is utilized to heat cylinder 7 and thereby, to heat and dry material web 3 as it is guided over the surface of cylinder 7. Combustion unit 17 may include, e.g., one or several jet pipe(s) that have a number of nozzles and that may be pressurized with a liquid or gaseous fuel or flammable mixture. The fuel leaving the nozzles is burnt within the interior of cylinder 7 and the combustion gases produced therein are used directly to heat cylinder 7. In another embodiment of the present invention, the preferably gaseous fuel may be used for producing infrared radiation to heat up cylinder 7. In this manner, combustion unit 17 can be constructed as a generally known infrared radiator, which will be discussed in greater detail below. Notwithstanding the specific structure of combustion unit 17, which may be freely selected, the combustion gases produced in the combustion process, which may attain temperatures of up to approximately 900° C. and above, are utilized to directly heat cylinder 7. In this manner, because cylinder 7 may be heated to significantly higher temperatures than conventional steam-heated cylinders, an intense drying of material web 3 is possible. When directly heated, cylinder 7 may be heated to a temperature of, e.g., between approximately 160° C. and 350° C. If necessary or desired, cylinder 7 may also be heated to temperatures greater than approximately 350° C. Because combustion unit 17 is placed within the interior of cylinder 7, material web 3 may be effectively heated with a relatively low energy input and higher vaporization rates are made possible.

Machine 1 may include a blower box 19 associated with deflection roll 11 that blasts a hot gas onto material web 3 as it is guided around an exterior of deflection roll 11. The blasted gas may have a temperature within a range of, e.g., approximately 250° C. to 450° C. In heating cylinder 7, combustion unit 17 may produce combustion gases/exhaust gases that escape from the interior of cylinder 7 that can be utilized as hot gas. However, prior to using the combustion/exhaust gases as the blast gas, it must be determined that the moisture content does not exceed a certain value and/or that the combustion gases are clean enough so as not to contaminate material web 3. The temperature of the escaping combustion gases of cylinder 7 may be, e.g., approximately 600° C. If this temperature is too high to be blasted onto material web 3 via blower box 19, the temperature of the combustion gas can be adjusted to a desired temperature value by admixing exhaust air from blower box 19 and/or fresh air.

In an exemplary embodiment of the present invention, a directly heated cylinder 9, either instead of or in addition to deflection roll 11, may be associated with blower box 19 as shown in dashed lines. Cylinder 9 may be heatable with steam or via a combustion unit. Material web 3 may be guided over the surface of cylinder 9 so as to heated on one side with hot gas from blower box 19, and heated on the other side by lying in contact with the surface or circumference of heated cylinder 9. Due to the intense heating on both sides of material web 3, the drying effect of dryer section 5 may be improved.

In the exemplary embodiment of the present invention, another combustion unit 17', which may be, e.g., an infrared radiator 21, may be associated with cylinder 7. Infrared radiator 21 may be mounted outside cylinder 7 and may extend over a circumferential area of cylinder 7 and at least approximately over the width of material web 3. Alternatively, combustion unit 17' may be formed by a plurality of adjacently arranged infrared radiators positioned to extend over a width of material web 3. In this manner, varying heating intensity may be applied across the width of material web 3 to regulate/control a moisture cross-directional profile of material web 3. Infrared radiator 21, which may produce infrared radiation by burning gas or a gas mixture, has a direct effect on permeable support belt 13. In this manner, web tears may be avoided or at least substantially reduced.

The combustion/exhaust gases produced during the combustion of the gaseous fuel or fuel mixture of infrared radiator 21 may be utilized to directly heat at least one cylinder, e.g., cylinder 7. In this regard, the combustion gases of infrared radiator 21 may be guided into the interior of cylinder 7 via suitable devices. Combustion unit 17' may be utilized in addition or as an alternative to combustion unit 17. In accordance with a particular embodiment of the present invention, combustion unit 17, e.g., an infrared radiator which is arranged in the interior of cylinder 7, may directly heat cylinder 7, and additional combustion unit 17', mounted outside cylinder 7, may heat material web 3 and support belt 13 with infrared radiation. This arrangement enables intense drying of material web 3 so that high drying rates can be achieved. In accordance with an alternative embodiment of the present invention, cylinder 7 may be heated exclusively by combustion unit 17' mounted outside cylinder 7. Moreover, the energy released during operation of combustion unit 17' may be utilized for heating material web 3 and support belt 13 guided around the outer surface or circumference of cylinder 7. Thus, an effective drying of material web 3 is economically achieved.

Infrared radiator 21 may be associated with cylinder 9, e.g., a steam-heated cylinder, with deflection roll 11, and/or with other cylinders/rolls of machine 1. The heat radiation of infrared radiator 21, which is located within dryer section 5, may also be utilized, e.g., in coating machines to act directly on material web 3 or support belt 13. As noted above, infrared radiator 21 may be arranged outside deflection roll 11 so that the heat radiation acts directly on material web 3 as it is guided around deflection roll 11. This may be particularly useful for web composed of, e.g., heavy cardboard.

The combustion gases of combustion unit 17' may be utilized by blower box 19 to blast hot gas onto material web 3 as it is guided around deflection roll 11. Because infrared radiator 21 is operated with a gaseous fuel, the combustion gases may be directed directly onto material web 3 via blower box 19.

It is clear from the FIGURE that two additional combustion units 17', e.g., infrared radiators 21*a* and 21*b*, may be positioned in front of cylinder 7 with respect to the web run direction 15. Infrared radiators 21*a* and 21*b* may be spaced from each other to create a gap 23 through which material web 3 and support belt 13 are guided. Infrared radiator 21*a* is positioned to act directly on support belt 13 and infrared radiator 21*b* is positioned to act directly on material web 3. In this manner, material web 3 may be heated up and dried. Exhaust/combustion gases of infrared radiators 21*a* and 21*b* may be utilized for directly heating a cylinder, e.g., cylinder 7, and for producing hot gas or for heating the hot gas for blower box 19. The heated gas may be blasted, via blower box 19, directly onto either support belt 13 or material web 3.

In a particular embodiment of the present invention, blower box 19 may include a plurality of zones that extend transversely to ran direction 15. The plurality of zones may be operated independent of each other to blast hot gas toward material web 3. Thus, it is possible to apply a hot gas having a temperature that varies over the width of material web 3. For example, a center region of blower box 19 may emit or apply a hot gas having a higher temperature and/or pressure and, therefore, having a higher blast velocity than gas applied by outer regions of blower box 19 onto shoulder regions of material web 3. In this manner, a cross-directional moisture profile of material web 3 may be adjusted or influenced in a defined, advantageous manner with a control system (not shown). In a particular embodiment, the cross-directional moisture profile of material web 3 may be automatically monitored or optimized at a random location after blower box 19, e.g., before a winding section, via a regulator unit that controls at least one of the blasting of the zones of blower box 19 and/or the directly heated cylinder.

As indicated in the FIGURE, blower box 19 (shown in dashed lines) can be associated with cylinder 9 so that the hot gas escaping from blower box 19 may be directed onto the appropriately temperature-resistant support belt 13, which presses material web 3 onto the surface of cylinder 9. The drying process of material web 3 may be further improved by heating support belt 13. In this particular embodiment, the hot gas may be additionally directly applied to material web 3 because the hot gas permeates through the mesh or pores of gas-permeable support belt 13.

The aforementioned process can ascertained from the above description of the FIGURE. The process includes blasting the combustion gases of a combustion unit 17 or 17' for directly heating a cylinder 7 onto material web 3 and/or onto support belt 13 on which material web 3 is placed via blower box 19. Alternatively, the combustion gases may be utilized to heat another gas, e.g., air, which is to be directed onto material web 3. Moreover, a combination of the above-noted possibilities is possible, i.e., the hot gas blasted onto material web 3 may be composed of combustion gases and another gas that has been each by the combustion gases.

The combustion gases of combustion units 17 and/or 17' may be utilized in additional blower boxes as hot gas to be blasted or for heating a gas that is to be blasted onto material web 3 or support belt 13 to dry material web 3.

Further, a separate combustion unit 17, e.g., mounted within the interior of a cylinder, may be associated with each or a plurality of cylinders utilized for drying material web 3 to reduce space requirements. In some cases it may be sufficient to use one combustion unit for directly heating several, e.g., two or three, cylinders.

In a preferred embodiment, blower box 19 a suction-blower box, also referred to as a heavy-duty hood, that includes a plurality of zones positioned to face material web 3 that may, e.g., particularly at ends that face the shoulders of material web 3, exert a partial vacuum force. The hot gas, blasted onto material web 3 in a center region of suction-blower box 19 may escape, at least partially, in a direction of the web shoulders and be sucked up by the partial vacuum zones. In this manner, a temperature distribution of the hot gas across the width of material web 3 may be adjusted. Further, excessive drying of the shoulder regions may be substantially avoided.

Moreover, combustion units 17 and/or 17' and blower box 19, which have been discussed above with reference to a dryer section, may also be utilized in accordance with the features of the present invention in a wet section and/or a press section of material web manufacturing machine 1. Further, these elements, in accordance with the present invention, may be utilized within a material web treatment machine, e.g., a coating machine.

Dryer section 5 may formed by, e.g., one or more single-row and/or double-row dryer groups. The advantages, which result from the above-discussed features of the present invention, are equally applicable in dryer sections composed of double-row dryer groups. In a particular embodiment, combustion units 17 and/or 17', which directly heat a cylinder, may be arranged in another region of dryer section 5 than blower box(es) 19 to which they are coupled. Thus, the blower box(es) 19 may be utilized in a part of machine 1 that, with respect to the run direction, either precedes or follows combustion units 17 and/or 17'. Further, blower box 19 may be associated with a cylinder and/or a deflection roll of a single- or double-row dryer group and combustion unit 17 and/or 17' coupled to blower box 19 may be utilized in a subsequent, i.e., downstream, single- or double-row dryer group. In another variation, only one combustion unit 17 or 17' may be provided to directly heat all heatable cylinders of a dryer section.

From the above discussion of the present invention, it is apparant that infrared radiator 21 of combustion unit 17', which is associated with a cylinder or deflection roll, may also be utilized in conjunction with cylinders that are either exclusively or additionally steam-heated for drying material web 3.

From the above discussion, it is apparent that high vaporization rates and a high drying effect can be achieved through the features of the present invention. In some cases, the number of dryer cylinders may be reduced due to the high drying effect, thus shortening the necessary length of the machine. Further, the cross-directional profile control of the material properties, e.g., the moisture of the material web, can be intensified, therefore, improving the quality of the material web. Moreover, directly heated cylinder 7 and blower box 19 may form a compact unit so that an existing machine for manufacturing or treating material web 3 may be easily retro-fitted. Further, several directly heated cylinders 7 may be combined as a unit with one or several blower boxes 19.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for manufacturing or treating a material web comprising:

at least one heatable cylinder;

a combustion unit, the combustion unit being adapted to heat the at least one heatable cylinder with at least one of combustion gases and infrared radiation;

the material web being adapted to be guided one of alone and with a transport belt over the at least one heatable cylinder; and at least one blower box being positioned to direct a hot gas onto the material web, the hot gas comprising at least one of the combustion gas and a gas heated by the combustion gases.

2. An apparatus for manufacturing or treating a material web comprising:

at least one heatable cylinder;

a combustion unit, the combustion unit being adapted to heat the at least one heatable cylinder with at least one of combustion gases and infrared radiation;

the material web being adapted to be guided one of alone and with a transport belt over the at least one heatable cylinder;

at least one blower box being positioned to direct a hot gas onto the material web, the hot gas comprising at least one of the combustion gas and a gas heated by the combustion gases; and the hot gas comprising at least one of exhaust gas of the blower box and fresh air.

3. The apparatus in accordance with claim 1, the combustion unit comprising one of an oil and a flammable gas fuel.

4. The apparatus in accordance with claim 1, the combustion unit being positioned within an interior of the at least one heatable cylinder.

5. An apparatus for manufacturing or treating a material web comprising:

at least one heatable cylinder;

a combustion unit, the combustion unit being adapted to heat the at least one heatable cylinder with at least one of combustion gases and infrared radiation;

the material web being adapted to be guided one of alone and with a transport belt over the at least one heatable cylinder;

at least one blower box being positioned to direct a hot gas onto the material web, the hot gas comprising at least one of the combustion gas and a gas heated by the combustion gases;

a deflection roll, the material web being guided around the deflection roll; and the combustion unit being positioned opposite at least one of the at least one heatable cylinder and the deflection roll.

6. The apparatus in accordance with claim 1, the apparatus being adapted for use within at least one of a dryer section, a press section, and a wet section of a material web manufacturing machine.

7. An apparatus for manufacturing or treating a material web comprising:

at least one heatable cylinder;

a combustion unit, the combustion unit being adapted to heat the at least one heatable cylinder with at least one of combustion gases and infrared radiation;

the material web being adapted to be guided one of alone and with a transport belt over the at least one heatable cylinder;

at least one blower box being positioned to direct a hot gas onto the material web, the hot gas comprising at least one of the combustion gas and a gas heated by the combustion gases;

the at least one blower box comprising a plurality of zones that extend transversely to a web run direction; and the plurality of zones being adapted to blast the hot gas independently of each other.

8. The apparatus in accordance with claim 7, further comprising a regulator/control unit that influences at least one of a temperature and an amount of gas to be fed into the plurality of zones.

9. An apparatus for manufacturing or treating a material web comprising:

at least one heatable cylinder;

a combustion unit, the combustion unit being adapted to heat the at least one heatable cylinder with at least one of combustion gases and infrared radiation;

the material web being adapted to be guided one of alone and with a transport belt over the at least one heatable cylinder;

at least one blower box being positioned to direct a hot gas onto the material web, the hot gas comprising at least one of the combustion gas and a gas heated by the combustion gases; and a deflection roll, the material web being guided around the deflection roll; and the at least one blower box being associated with at least one of the at least one heatable cylinder and the deflection roll.

10. The apparatus in accordance with claim 1, the at least one heatable cylinder being adapted to be heated to a temperature between approximately 100° C. and 400° C.

11. The apparatus in accordance with claim 10, the at least one heatable cylinder being adapted to be heated to a temperature between approximately 160° C. and 350° C.

12. The apparatus in accordance with claim 1, the hot gas being adapted to be heated to a temperature between approximately 150° C. and 600° C.

13. The apparatus in accordance with claim 12, the hot gas being adapted to be heated to a temperature between approximately 250° C. and 450° C.

14. The apparatus in accordance with claim 1, the material web comprising one of a paper web and a cardboard web.

15. A process for drying a material web in a machine for manufacturing or treating a material web that includes at least one heatable cylinder, a combustion unit, and at least one blower box, the process comprising:

heating the at least one heatable cylinder with at least one of combustion gases and infrared radiation of the combustion unit;

guiding the material web, one of alone and with a transport belt, over the at least one heated cylinder; and directing a hot gas from the blower box onto the material web, the hot gas being at least one of the combustion gas and a gas heated by the combustion gases.

16. A process for drying a material web in a machine for manufacturing or treating a material web that includes at least one heatable cylinder, a combustion unit, and at least one blower box, the process comprising:

heating the at least one heatable cylinder with at least one of combustion gases and infrared radiation of the combustion unit;

guiding the material web, one of alone and with a transport belt, over the at least one heated cylinder;

directing a hot gas from the blower box onto the material web, the hot gas being at least one of the combustion gas and a gas heated by the combustion gases; and feeding at least one of exhaust gas from the blower box and fresh air into the hot gas.

17. The process in accordance with claim 15, further comprising fueling the combustion unit with one of oil and flammable gas.

18. A process for drying a material web in a machine for manufacturing or treating a material web that includes at least one heatable cylinder, a combustion unit, and at least one blower box, the process comprising:

heating the at least one heatable cylinder with at least one of combustion gases and infrared radiation of the combustion unit;

guiding the material web, one of alone and with a transport belt, over the at least one heated cylinder;

directing a hot gas from the blower box onto the material web, the hot gas being at least one of the combustion gas and a gas heated by the combustion gases; and separating the blower box into a plurality of zones to blast the hot gas across a width of the material web.

19. The process in accordance with claim 18, further comprising controlling/regulating at least one of a temperature and an amount of gas being fed into the plurality of zones.

20. The process in accordance with claim 15, wherein the at least one cylinder is heated to a temperature between approximately 100° C. and 400° C.

21. The process in accordance with claim 20, wherein the at least one cylinder is heated to a temperature between approximately 160° C. and 350° C.

22. The process in accordance with claim 15, wherein the hot gas is heated to a temperature between approximately 150° C. and 600° C.

23. The process in accordance with claim 22, wherein the hot gas is heated to a temperature between approximately 250° C. and 450° C.

24. The process in accordance with claim 15, wherein the material web is comprised of one of a paper and a cardboard web.

25. A process for manufacturing or treating a material web in a web producing machine comprising:

directly heating a cylinder of the machine with combustion gases of a combustion unit; and applying the heated gas toward the material web via a blower box, the heated gas being at least one of the combustion gases and a gas heated by the combustion gases.

26. A process for manufacturing or treating a material web in a web producing machine comprising:

directly heating a cylinder of the machine with combustion gases of a combustion unit;

applying the heated gas toward the material web via a blower box, the heated gas being at least one of the combustion gases and a gas heated by the combustion gases;

guiding the material web over the heated cylinder with a transport belt; and directing the applied heated gas through the transport belt to the material web.

27. A web manufacturing or treating apparatus comprising:

at least one heatable cylinder;

a combustion unit, the combustion unit being adapted to produce combustion gas to heat the at least one heatable cylinder;

the material web being adapted to be guided by a belt over the at least one heatable cylinder; and at least one blower box being positioned to direct a hot gas composed of one of the combustion gas and a gas heated by the combustion gas onto the material web.

28. A web manufacturing or treating apparatus comprising:

at least one heatable cylinder;

a combustion unit, the combustion unit being adapted to produce combustion gas to heat the at least one heatable cylinder;

the material web being adapted to be guided by a belt over the at least one heatable cylinder;

at least one blower box being positioned to direct a hot gas composed of one of the combustion gas and a gas heated by the combustion gas;

a transport belt being adapted to guide the material web over the at least one heatable cylinder; and the at least one blower box being positioned to direct the hot gas onto the material web through the transport belt.

* * * * *